US006364311B1

(12) United States Patent
Merz et al.

(10) Patent No.: US 6,364,311 B1
(45) Date of Patent: Apr. 2, 2002

(54) NEGATIVE-PRESSURE CONTROL FOR A LATERAL PULLING DEVICE

(75) Inventors: Michael Merz, Sandhausen; Markus Möhringer, Mannheim, both of (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/531,342

(22) Filed: Mar. 20, 2000

(30) Foreign Application Priority Data

Mar. 19, 1999 (DE) ..... 199 12 532

(51) Int. Cl.[7] ..... B65H 9/16

(52) U.S. Cl. ..... 271/248; 271/250

(58) Field of Search ..... 271/236, 250, 271/252, 248

(56) References Cited

U.S. PATENT DOCUMENTS 4,227,685 A * 10/1980 Fischer ..... 271/236 X
5,820,123 A * 10/1998 Gihr et al. ..... 271/236

* cited by examiner

*Primary Examiner*—David H. Bollinger
(74) *Attorney, Agent, or Firm*—Herbert L. Lerner; Laurence A. Greenberg; Werner H. Stemer

(57) ABSTRACT

A method of controlling negative-pressure level of a lateral pulling device for laterally aligning sheets through the intermediary of a rotary valve, includes having, during an accelerating phase of the lateral pulling device, a high-level negative pressure at a suction pull bar of the lateral pulling device; upon reaching a maximum and constant speed of the suction pull bar, a medium-level negative pressure at the suction pull bar; and, after reaching a desired pulling path of the suction pull bar, up to an end position of the suction pull bar, a low-level negative pressure and no negative pressure, respectively, at the suction pull bar; and a device for performing the method.

8 Claims, 3 Drawing Sheets

NEGATIVE-PRESSURE CONTROL FOR A LATERAL PULLING DEVICE

BACKGROUND OF THE INVENTION

Field of the Invention

The invention relates to a method and a device for controlling the negative-pressure level of a lateral pulling device for laterally aligning sheets by a pulling bar subjectible to the action of suction air at different pressure levels dependent upon the pulling path.

Such a device has become known heretofore from the published German Patent Document DE 35 21 691 A1 which discloses a rotary valve for controlling suction air for a pulling bar for laterally aligning sheets. A control groove of the rotary valve is thereby disposed so that an inlet opening for suction-air feed is already closed when the control groove reaches an opening for fresh-air feed. This measure makes it necessary to provide an additional solenoid valve which is switched at high frequency, with the result that fresh air or compressed air is fed to the control groove. This measure continuously decreases the retaining force between the pulling bar and a sheet.

SUMMARY OF THE INVENTION

It is accordingly an object of the invention to provide a method and a relatively simple device for ensuring that the sheets which are to be aligned are transported reliably against a lateral stop and strike against the lateral stop with a low retaining force and, irrespective of the pulling path, virtually at the same speed.

With the foregoing and other objects in view, there is provided, in accordance with one aspect of the invention, a method of controlling negative-pressure level of a lateral pulling device for laterally aligning sheets through the intermediary of a rotary valve, which comprises having, during an accelerating phase of the lateral pulling device, a high-level negative pressure at a suction pull bar of the lateral pulling device; upon reaching a maximum and constant speed of the suction pull bar, a medium-level negative pressure at the suction pull bar; and, after reaching a desired pulling path of the suction pull bar, up to an end position of the suction pull bar, a low-level negative pressure and no negative pressure, respectively, at the suction pull bar.

In accordance with another mode, the method of the invention comprises having, during a rearward movement of the suction pull bar, no negative pressure at the suction pull bar.

In accordance with a further aspect of the invention, there is provided a device for controlling negative-pressure level of a lateral pulling device for laterally aligning sheets which are fed to a sheet-processing machine, including a suction pull bar movable in time with the sheet-processing machine and subjectible to action of suction air at different pressure levels, and a rotary valve having a rotary part formed with a control groove for controlling the suction air, comprising structure defining a connecting opening to the negative-pressure source, a connecting opening to the suction pull bar and an aerating opening, the control groove being of such length as to connect said openings to one another at least once during an operating cycle.

In accordance with another feature of the invention, the control groove is formed with an end having a pass-through cross section that is reduced in size relative to the rest of the control groove.

In accordance with a further feature of the invention, the openings are arranged within an angle smaller than 180°.

In accordance with an added feature of the invention, the device includes a suction channel connecting the suction pull bar to the rotary valve, the suction channel having a width, at an opening to the moving suction pull bar, that is wider by a multiple than the diameter of the suction channel.

In accordance with an additional feature of the invention, the rotary valve is drivable via a mechanical coupling with the sheet-processing machine.

In accordance with a concomitant feature of the invention, the rotary valve is drivable by an adjusted electric motor.

It is an advantage of the invention that the sheets which are to be aligned laterally are aligned gently against the lateral stops, thereby avoiding damage to the lateral sheet edge. At the same time, a rebounding of the sheet from the lateral stop is also avoided, with the result that the sheet can be fed very precisely to the sheet-processing machine.

A high retaining force between the sheet and the pull bar is advantageously produced during an accelerating phase of the pulling device for the lateral alignment of the sheet. After a short accelerating path, the pressure is lowered extremely quickly because only a small retaining force is required for transporting the sheets at constant speed. Upon reaching the end of the pulling path, the opening for the suction-air feed is fully covered and the pull bar is connected, via the control groove, to a bypass opening to ambient air, and as a result there is no longer any retaining force present between the pull bar and the sheet. This state is also maintained when the pull bar executes its rearward movement.

It is also extremely advantageous that the pulling path can vary within a wide range (approximately 2 to 10 mm), the conditions for arrival at the stop (speed and retaining force) being kept constant. This results in a robust sheet travel.

In an advantageous configuration of the subject matter of the invention, the control groove is formed with such a length that all the openings of the rotary valve, i.e., to the suction-air source, to the suction pull bar and to the bypass, are connected to one another at least once during an operating cycle. In a further advantageous configuration, the openings are arranged over an angle range smaller than 180°.

In an advantageous development of the subject matter of the invention, provision is made for the control groove to be provided, in the end or trailing region thereof, with a smaller pass-through cross section than in the front or leading region thereof. This measure results in maintaining the energy consumption, brought about by the pressure drop at the bypass valve, at a low level.

Other features which are considered as characteristic for the invention are set forth in the appended claims.

Although the invention is illustrated and described herein as embodied in a negative-pressure control for a lateral pulling device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
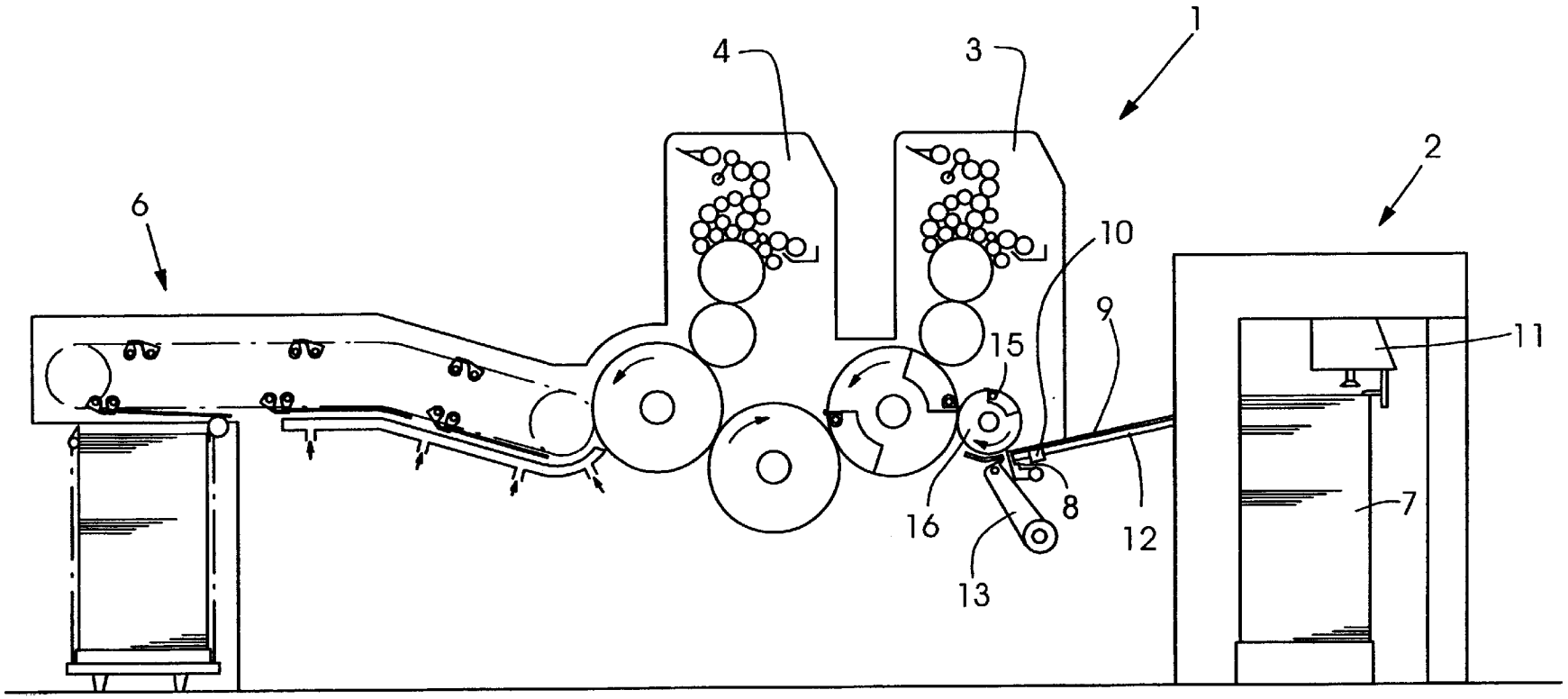
FIG. 1 is a diagrammatic side elevational view of a sheet-fed rotary printing machine incorporating the negative-pressure control for a lateral pulling device according to the invention.

Referring now to the drawings and, first, particularly to FIG. 1 thereof, there is shown therein a sheet-fed rotary printing machine 1 having a feeder 2, a number of printing units 3, 4, but at least one printing unit 3 or 4, and a delivery 6. The sheets 9 are singly separated from a feed pile 7 of the feeder 2 by a separating unit 11 and conveyed to the sheet-fed rotary printing machine 1 via a feeding table 12. Provided at an end of the feeding table 12, which is directed towards the printing machine, is a lateral pulling device 10 for laterally aligning the sheets 9, as well as front stops 8 for aligning front or leading edges of the sheets 9. After the aligning operation has taken place, the sheets 9 are received by a pivotably arranged pre-gripper 13, which transfers the sheets 9 to a gripper device 15 of a feed drum 16 of the sheet-fed rotary printing machine 1.

The device 10 for the lateral alignment of the sheets 9 has, inter alia, lateral stops 14 (note FIG. 3) disposed at the sides of the sheet-transporting plane. As shown, for example, in FIG. 2, a so-called pull bar 17 which is subjectible to the action of suction air, is driven in time with the sheet-processing machine 9 by a cam disc. A rotary valve 18, which has a housing 19, is provided for the purpose of controlling the supply of suction air to the suction pull bar 17. Provided in an upper part of the housing 19 is a negative-pressure channel 21 which is in contact with suction openings 22 formed in the suction pull bar 17. The negative-pressure channel 21 has a width B at an opening 20 to the movable suction pull bar 17, which is greater by a multiple than the diameter of the suction channel 21, so that the suction pull bar 17 is always in operative connection with the suction channel 21 during the pulling movement (note FIG. 3).

The rotary valve 18 has a rotatably mounted inner part 24 formed with a control groove 26 and driven in time with the sheet-processing machine. The drive may take place either directly by the sheet-processing machine, e.g. via a cam, mechanical coupling, or by a separate drive, e.g. an electric motor. In this case, speed-dependent leading or lagging may be adjusted or set in relation to the movement of the suction pull bar 17. A bypass opening 28 to ambient air is arranged downline of an opening 27 to the suction channel 21, as seen in the direction of rotation indicated by the associated curved arrow. The distance between the openings 27 and 28 is approximately $\psi$=30 angular degrees.

An opening 29 to the negative-pressure source 31 is located at an angle $\psi$=approximately 90° upline of the opening 27, as viewed in the direction of rotation of the inner part 24.

Figure 2:
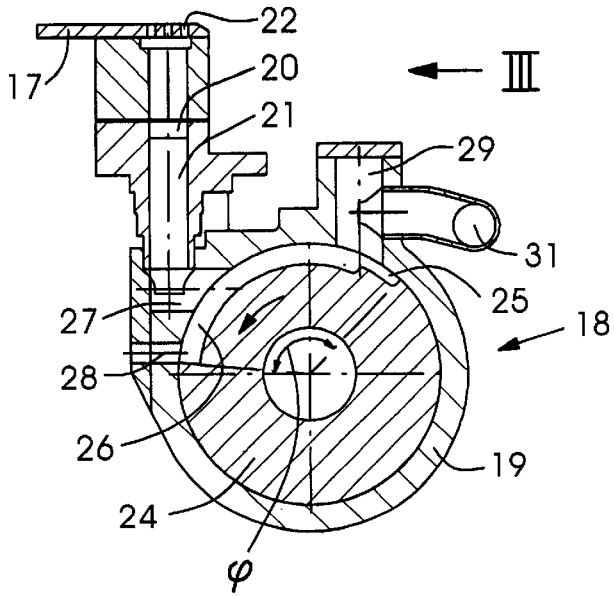
FIG. 2 is an enlarged fragmentary cross-sectional view of FIG. 1 showing, in greater detail, the lateral pulling device according to the invention having a rotary valve.
Figure 3:
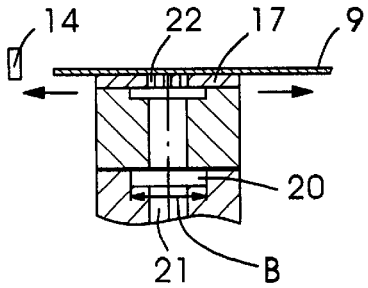
FIG. 3 is an enlarged fragmentary view of FIG. 2 showing a section through a suction channel of the lateral pulling device as viewed in the sheet-transporting direction.

The control groove 26 is provided on the circumference of the inner part 24 over an angle of rotation $\psi$=smaller than 180°, preferably approximately 135 angular degrees, and is of such length that it connects all the openings 27, 28 and 29 to one another at least once during a rotation (note, in particular, FIG. 2).

In the end or trailing region 25 thereof, the control groove 26 has a smaller through-passage cross section than in the front or leading region thereof. This avoids excessively high suction-air throughput and thus energy consumption during the time over which the suction-air source 31 is connected to the bypass opening 28 via the control groove 26.

The beginning and the end of the control groove can be adapted, by premature activation, to the inertia of the air column in the pulling channels so as to give the desired control time at the pulling plate, for example during the maximum printing speed of the sheet-fed machine.

Figure 4:
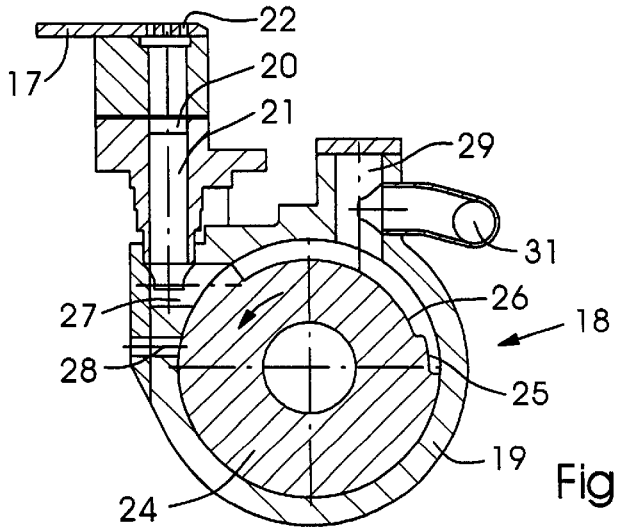
FIGS. 4 to 7 are views like that of FIG. 2, showing the rotary part of the rotary valve in different phase positions.

The drawing according to FIG. 4 shows the control groove 26 just as it reaches the opening 27 to the suction channel 21 and thus connects the suction source 31 to the suction pull bar 17. This measure subjects the suction pull bar 17, or the suction openings 22, which are directed towards the sheet 9 that is to be aligned, to the negative-pressure level produced by the suction source 31.

Figure 5:
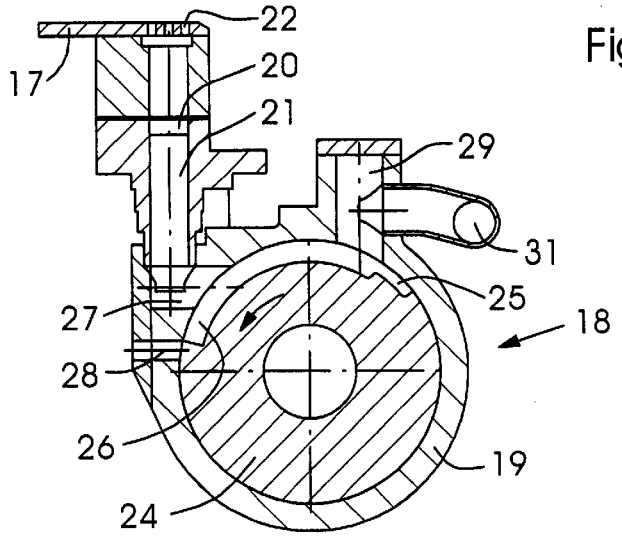

An accelerating phase of the lateral sheet alignment begins the instant of time that the control groove 26 fully connects the opening 29 to the suction source 31, and the opening 27 to the suction pull bar 17 to one another, and the negative pressure between the sheet and the suction pull bar 17 has been built up (preliminary control). At this point in time, the highest negative pressure is present at the pull bar 17, and the sheet 9 is subjected to the maximum retaining force. The high negative-pressure level is present at the suction pull bar 17 until the control groove 26 reaches the bypass opening 28 according to FIG. 5.

From this instant of time on, the speed of the suction pull bar 17 is kept constant, and the control groove 26 has air admitted thereto via the bypass 28, with the result that only a small retaining force is then present at the suction pull bar 17.

Figure 6:
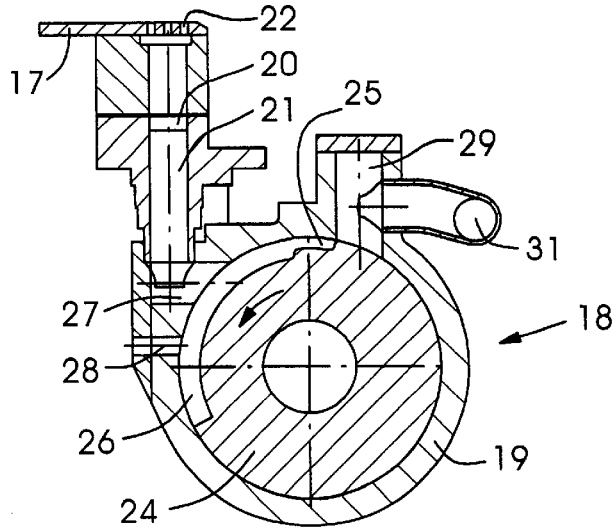

The pulling end of the suction pull bar 17 is determined by the opening 29 of the negative-pressure source 31 being covered by the inner part 24 of the rotary valve 18. The opening 27 of the suction pull bar 17 is then only connected to the bypass opening 28 via the control groove 26. This measure quickly decreases the then present negative pressure, and the suction pull bar 17 no longer subjects the sheet 9 to any retaining force (note, in particular, FIG. 6). The movement of the suction pull bar 17 then undergoes a braking phase until it is at a standstill.

Figure 7:
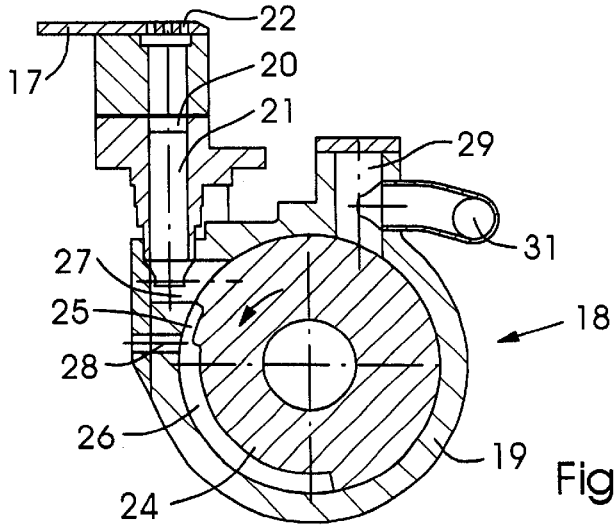

During the rearward movement of the suction pull bar 17, the opening 27 of the suction pull bar 17 remains covered by the inner part 24 of the rotary valve 18 (FIG. 7). While the beginning of the control groove 26 rotates farther to the opening 29 of the negative-pressure source 31, the aligned sheet 9 is fed to the sheet-processing printing machine, and the following sheet passes to the front stops 8 and is thus ready for the next lateral alignment.

We claim:

1. A method of controlling negative-pressure level of a lateral pulling device for laterally aligning sheets through the intermediary of a rotary valve, the method which comprises:

providing during an accelerating phase of the lateral pulling device, a high-level negative pressure at a suction pull bar of the lateral pulling device;

providing upon reaching a maximum and constant speed of the suction pull bar, a medium-level negative pressure at the suction pull bar; and providing after reaching a desired pulling path of the suction pull bar, up to an end position of the suction pull bar, a low-level negative pressure and no negative pressure, respectively, at the suction pull bar.

2. The method according to claim 1, which comprises providing, during a rearward movement of the suction pull bar, no negative pressure at the suction pull bar.

3. A device for controlling negative-pressure level of a lateral pulling device for laterally aligning sheets which are fed to a sheet-processing machine, the device comprising:

a suction pull bar movable in time with the sheet-processing machine and subjectible to action of suction air at different pressure levels;

a rotary valve having a rotary part formed with a control groove for controlling the suction air; and a structure defining a connecting opening to a negative-pressure source, a connecting opening to the suction pull bar and an aerating opening;

the control groove being of such length as to connect said openings to one another at least once during an operating cycle.

4. The device according to claim 3, wherein the control groove is formed with an end having a pass-through cross section that is reduced in size relative to the rest of the control groove.

5. The device according to claim 4, including a suction channel connecting the suction pull bar to the rotary valve, said suction channel having a width, at an opening to the moving suction pull bar, that is wider by a multiple than the diameter of said suction channel.

6. The device according to claim 3, wherein said openings are arranged within an angle smaller than 180°.

7. The device according to claim 3, wherein the rotary valve is drivable via a mechanical coupling by the sheet-processing machine.

8. The device according to claim 3, wherein the rotary valve is drivable by an adjusted electric motor.

* * * * *